US008640993B2

(12) United States Patent
Culbreath

(10) Patent No.: US 8,640,993 B2
(45) Date of Patent: Feb. 4, 2014

(54) PARACHUTE ASSEMBLIES FOR TRAINING PERSONS TO CATCH AN OBJECT IN FLIGHT SUCH AS A BALL

(76) Inventor: Marcus Culbreath, North Augusta, SC (US)

( * ) Notice: Subject to any disclaimer, the term of this patent is extended or adjusted under 35 U.S.C. 154(b) by 0 days.

(21) Appl. No.: 13/455,630

(22) Filed: Apr. 25, 2012

(65) Prior Publication Data

US 2012/0273620 A1 Nov. 1, 2012

Related U.S. Application Data

(60) Provisional application No. 61/479,121, filed on Apr. 26, 2011.

(51) Int. Cl.
*B64D 17/02* (2006.01)

(52) U.S. Cl.
USPC ..... 244/145; 244/142; 446/34; 446/49

(58) Field of Classification Search
USPC ..... 244/145, 138 R, 142, 151 R, 151 A, 152, 244/902; 446/34, 49
See application file for complete search history.

(56) References Cited

U.S. PATENT DOCUMENTS

| | | | | |
|---|---|---|---|---|
| 3,278,143 | A | 10/1966 | Engel, Jr. | |
| 4,993,667 | A | 2/1991 | Uotila | |
| 5,472,155 | A * | 12/1995 | Mastrolia | 244/151 A |
| 5,530,445 | A * | 6/1996 | Veazey | 342/8 |
| 5,738,307 | A * | 4/1998 | Webb | 244/152 |
| 5,755,405 | A * | 5/1998 | Socha et al. | 244/142 |
| 5,839,695 | A * | 11/1998 | Puskas | 244/145 |
| 6,328,263 | B1 * | 12/2001 | Benney et al. | 244/142 |
| 6,382,564 | B1 * | 5/2002 | Sego, Jr. | 244/151 A |
| 6,503,119 | B1 * | 1/2003 | Lapointe | 446/34 |
| 6,830,220 | B2 * | 12/2004 | Runyan | 244/155 A |
| 7,178,762 | B2 * | 2/2007 | Preston | 244/142 |
| 7,195,205 | B1 * | 3/2007 | Lee | 244/149 |
| 7,293,742 | B2 | 11/2007 | Sadeck | |
| 7,997,535 | B2 * | 8/2011 | Babovka | 244/145 |
| 2001/0030262 | A1 * | 10/2001 | Coe | 244/151 R |
| 2001/0050323 | A1 * | 12/2001 | Brownell | 244/142 |
| 2004/0135033 | A1 * | 7/2004 | Hung | 244/142 |
| 2007/0257155 | A1 * | 11/2007 | Sadeck | 244/142 |
| 2010/0255939 | A1 | 10/2010 | York | |

* cited by examiner

*Primary Examiner* — Christopher P Ellis
*Assistant Examiner* — Medhat Badawi
(74) *Attorney, Agent, or Firm* — Culhane Meadows PLLC; J. Scott Anderson

(57) ABSTRACT

Devices, methods, and systems for slowing the descent of an object in flight such as a baseball using a parachute are presented. A parachute assembly includes a canopy attached to a plurality of suspension lines converging downwardly to a corresponding number of attachment points on the surface of a ball. The attachment points are substantially equidistantly spaced apart along a line of substantially equal latitude. In one embodiment, each attachment point defines an opening to an interior channel extending to a central chamber. Each suspension line is inserted into an interior channel, through the central chamber, and out of the ball through a common shaft, where the lines are fastened together in a bundle and then withdrawn until the bundle lies in the central chamber, retaining the lines inside the ball.

3 Claims, 6 Drawing Sheets

PARACHUTE ASSEMBLIES FOR TRAINING PERSONS TO CATCH AN OBJECT IN FLIGHT SUCH AS A BALL

CROSS-REFERENCE TO RELATED APPLICATIONS

This application claims the benefit of and priority to U.S. Provisional application No. 61/479,121, entitled "Parachute Assemblies For Training Persons To Catch An Object In Flight Such As A Ball," filed Apr. 26, 2011, which is herein incorporated by reference in its entirety.

BACKGROUND

The following disclosure relates generally to the field of sporting equipment and, more specifically, to a system for launching and then slowing the descent an object in flight, such as a ball, so that a person can practice throwing, hitting, kicking, or catching the object.

Catching a ball that is falling at full speed requires training, practice and skill, and can be especially difficult for young children and beginners. Training techniques such as gentle throwing are generally not adequate because, for example, the object or ball still accelerates at full speed, due to gravity, during its descent. Using alternative objects such as lightweight balls is also not adequate because, for example, training with such objects provides no experience hitting or catching the ball used in actual play. Accordingly, there is a need for improved systems for and methods of launching and then slowing an object such as a ball during its descent.

SUMMARY

A parachute assembly for slowing the descent of an object in flight, according to various embodiments, comprises a canopy having a peripheral skirt portion and a plurality of suspension lines attached at the upper ends thereof to the peripheral skirt portion and converging downwardly to a corresponding number of attachment points located along an upper hemisphere of a ball. The attachment points are substantially equidistantly spaced apart and thereby facilitate a substantially equidistant spacing of the plurality of suspension lines.

A method of attaching a parachute assembly to a ball, according to various embodiments, includes the steps of: (1) locating a plurality of attachment points for receiving a plurality of suspension lines, wherein the attachment points are substantially equidistantly spaced apart along an upper hemisphere of a ball; (2) making a plurality of interior channels into the ball, each extending from an opening defined by one of the plurality of attachment points to a central chamber located near a geometric center of the ball; (3) making a common shaft into the ball extending from a shaft opening located on an outer surface of the ball to the central chamber; (4) inserting the plurality of suspension lines into and through the plurality of interior channels, into and through the common shaft, and through the shaft opening; (5) fastening together the plurality of suspension lines to form a bundle; and (6) withdrawing the plurality of suspension lines until the bundle lies near the central chamber.

BRIEF DESCRIPTION OF THE DRAWINGS

Reference will now be made to the accompanying drawings, which are not necessarily drawn to scale, and wherein.

DETAILED DESCRIPTION OF VARIOUS EMBODIMENTS

Figure 1:
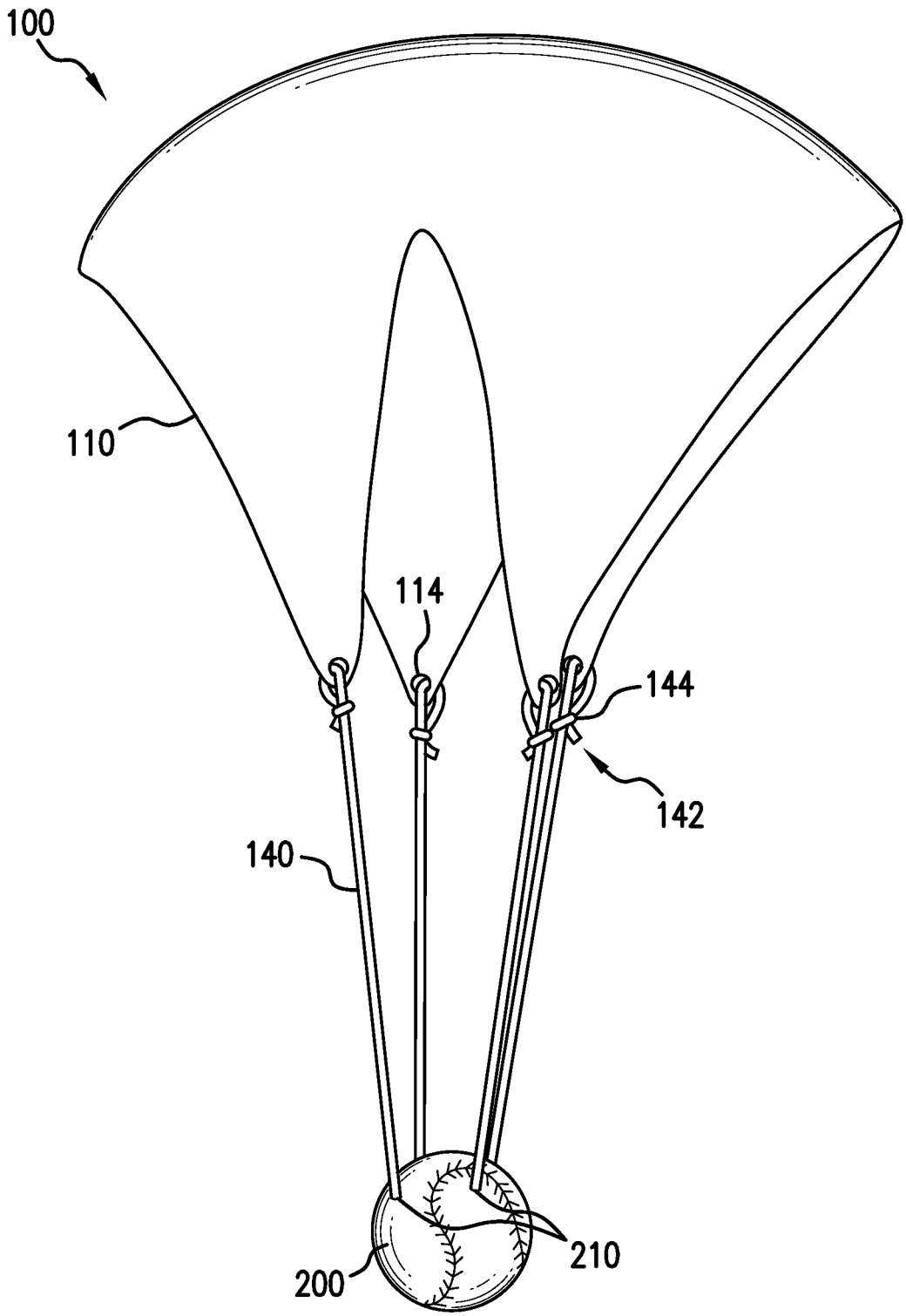
FIG. 1 is a perspective illustration of a parachute assembly attached to a ball, according to various embodiments.

The present systems and apparatuses and methods are understood more readily by reference to the following detailed description, examples, drawing, and claims, and their previous and following descriptions. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching in its best, currently known embodiment. To this end, those skilled in the relevant art will recognize and appreciate that many changes can be made to the various aspects described herein, while still obtaining the beneficial results of the technology disclosed. It will also be apparent that some of the desired benefits can be obtained by selecting some of the features while not utilizing others. Accordingly, those with ordinary skill in the art will recognize that many modifications and adaptations are possible, and may even be desirable in certain circumstances, and are a part of the invention described. Thus, the following description is provided as illustrative of the principles of the invention and not in limitation thereof.

As used throughout, the singular forms "a," "an" and "the" include plural referents unless the context clearly dictates otherwise. Thus, for example, reference to "a" component can include two or more such components unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Also, as used herein, the term "facilitate" means to make easier or less difficult and the term "impede" means to interfere with, hinder, or delay the progress of.

Parachute Assembly

Although the various embodiments are described with reference to a baseball, the assemblies and methods may be used with any of a number of balls or objects. As used herein, the term "ball" means a round or roundish body or mass, including a generally spherical or ovoid body of any kind, such as those used for throwing, hitting, kicking, or catching in games or sports such as baseball, softball, cricket, volleyball, soccer, rugby, field hockey, lacrosse, football, golf, tennis, table tennis, racquetball, squash, and handball.

A parachute is a device used to slow the descent of an object through an atmosphere. A simple parachute includes a canopy connected to an object by a number of cords often referred to as shroud lines or suspension lines. Generally, once a cord or rope is assigned a function, the result may be referred to as a line. Depending on the object and the purpose of the parachute, the suspension lines 140 may be made from any type of cord, including a single filament or fiber, thread, string, twine, wire, cord, or rope (twisted, woven, or braided, etc.), made from one or more strands of natural and/or artificial fibers. In one embodiment, the suspension lines 140 may be covered by a thermoplastic outer sheath, such as a clear vinyl, in order to facilitate canopy opening and to impede tangling of the lines with one another.

FIG. 1 is an illustration of a parachute assembly 100 attached to a ball 200, according to various embodiments. The parachute assembly 100 includes a canopy 110 connected to plurality of suspension lines 140 which are converging downwardly to a corresponding number of attachment points 210 located along the upper hemisphere of the ball 200. Although FIG. 1 shows four suspension lines 140, any number of lines 140 may be used between the ball 200 and the parachute canopy 110. The suspension lines 140 may be made of nylon cord or any other type of line that is suitable in size, shape and strength to support a ball 200 in flight, suspended from the parachute canopy 110.

The canopy 110 has a peripheral skirt portion that is located generally along the edges of the canopy fabric. The canopy 110 may be made of silk, ripstop nylon, or other suitable fabric. The size of the canopy 110 may vary according to the weight of the ball 200 and the desired rate of descent. The canopy 110 may be rectangular, round, or any other suitable shape.

As shown, the upper end 142 of each suspension line 140 may be passed through an eyelet 114 or other suitable opening in the canopy fabric, and then joined to itself using a fastener 142 to form a loop. The eyelet 114 may be located in the peripheral skirt portion of the canopy 110. The eyelet 114 may include a grommet or other reinforcement for strength and durability.

In an alternate embodiment, a riser may be disposed between the suspension lines 140 and the canopy 110. Each riser may be made of be a strip of semi-flexible webbing that is stitched or otherwise attached at its upper end to the canopy 110. The suspension line 140 may pass through a hole or other suitable opening in the riser and make a loop. Any of a variety of riser assemblies known in the art may be used to facilitate the connection between the suspension lines 140 and the canopy 110.

The attachment points 210, as illustrated in FIG. 1, are located along the upper hemisphere of the ball 200. The term "attachment point" is not meant to refer to a geometric point. Instead, the attachment point refers to the area or zone where the suspension line 140 is attached to the ball 200. The attachment points 210 are substantially equidistantly spaced apart in order to facilitate the substantially equidistant spacing of the suspension lines 140.

Figure 2:
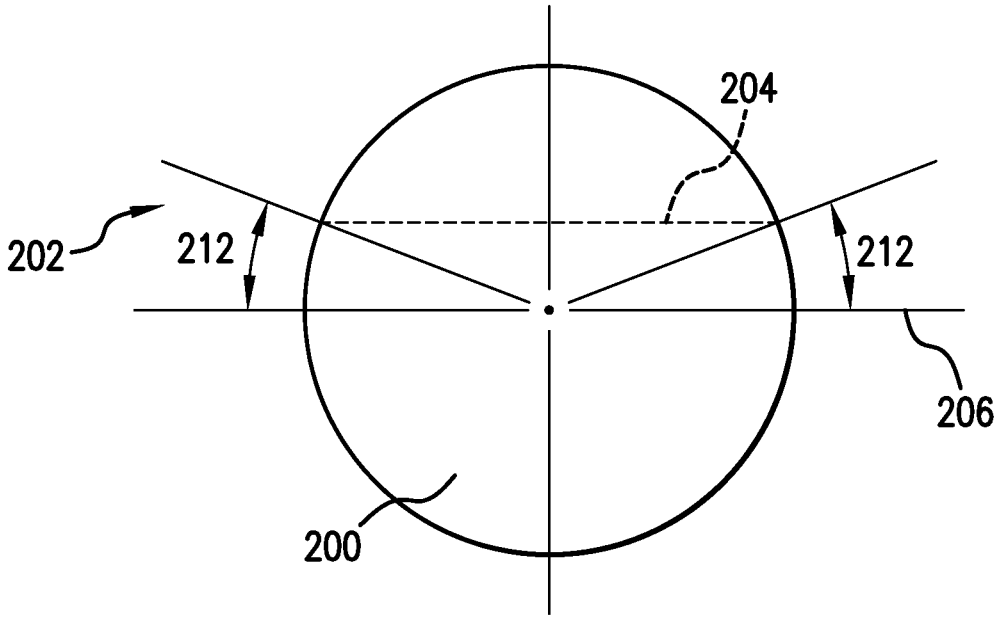
FIG. 2 is a side view of a ball, showing an equatorial plane and a line of substantially equal latitude along which one or more attachment points may be located, according to various embodiments.
Figure 3:
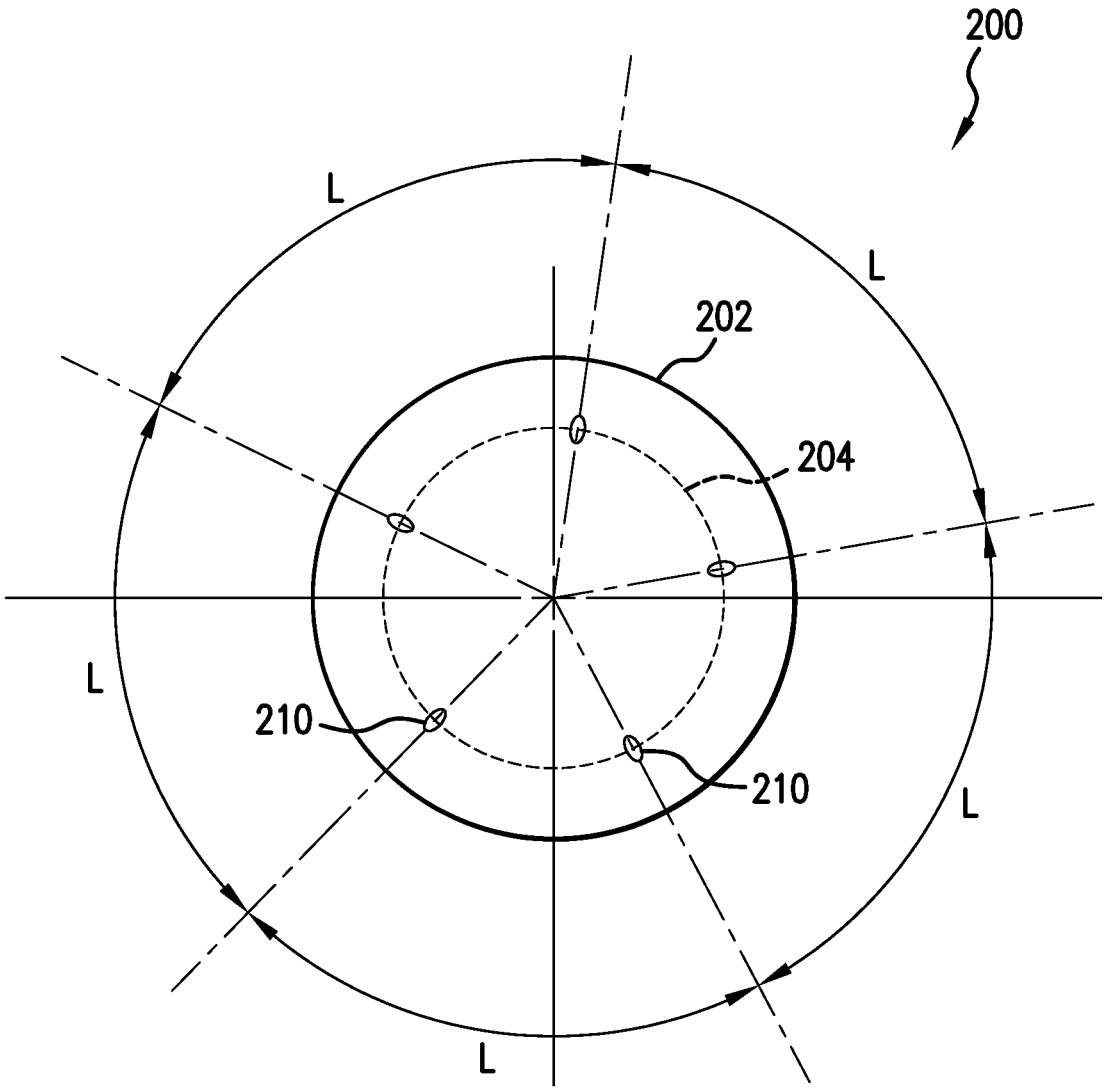
FIG. 3 is an overhead view of the upper hemisphere of a ball, showing the circumference of the ball divided into substantially equal longitudinal increments, according to various embodiments.

Location of the attachments points 210 is illustrated in FIG. 2 and FIG. 3. As shown in a side view in FIG. 2, the ball 200 may be characterized as having an equator, an upper hemisphere 202, a lower hemisphere, and an equatorial plane 206 passing through the center region of the ball 200. The attachment points, in one embodiment, may be located along a line of substantially equal latitude 204. As shown, the line of substantially equal latitude 204 is defined by a constant angle of inclination 212 relative to the equatorial plane 206. In one embodiment, the angle of inclination 212 may be between about twenty degrees to about sixty degrees. The attachment points may be substantially equidistantly spaced apart along the line of substantially equal latitude 204. The spacing depends on the number of suspension lines and corresponding attachment points.

As shown in the overhead view in FIG. 3, the line of substantially equal latitude 204 extends around the entire circumference of the ball 200. In this exemplary embodiment, there are five suspension and five corresponding attachment points 210. As shown, each of the five attachment points 210 lies along the line of substantially equal latitude 204. In order to accomplish the substantially equidistant spacing of the attachment points 210, the circumference (i.e., three hundred sixty degrees) of the ball 200 may be divided by the number of suspension lines, N, in order to calculate the longitudinal spacing L (in degrees). For the embodiment illustrated, the number of suspension lines, N, equals five; three hundred sixty degrees divided by N (five) equals a longitudinal spacing, L, of seventy-two degrees. So for N=5, L=seventy-two degrees. Similarly, for N=4, L=ninety degrees. For N=3, L=one hundred twenty degrees.

Although the line of equal latitude 204 may be located precisely, and the above formula calculates a precise division of the circumference into equal longitudinal spaces, the spacing of the attachment points 210 should be considered substantially equidistant as long as the attachment points 210 on an object such as a ball 200 lie within a range of about plus-or-minus ten percent with respect to the calculated locations.

The suspension lines 140 may be attached to the outer surface of the upper hemisphere 202 of the ball 200 at the corresponding attachment points 210 using any of a variety of attachment methods. In one embodiment, each attachment point 210 defines an opening through which each suspension line 140 is inserted into the body of the ball 200.

Figure 5:
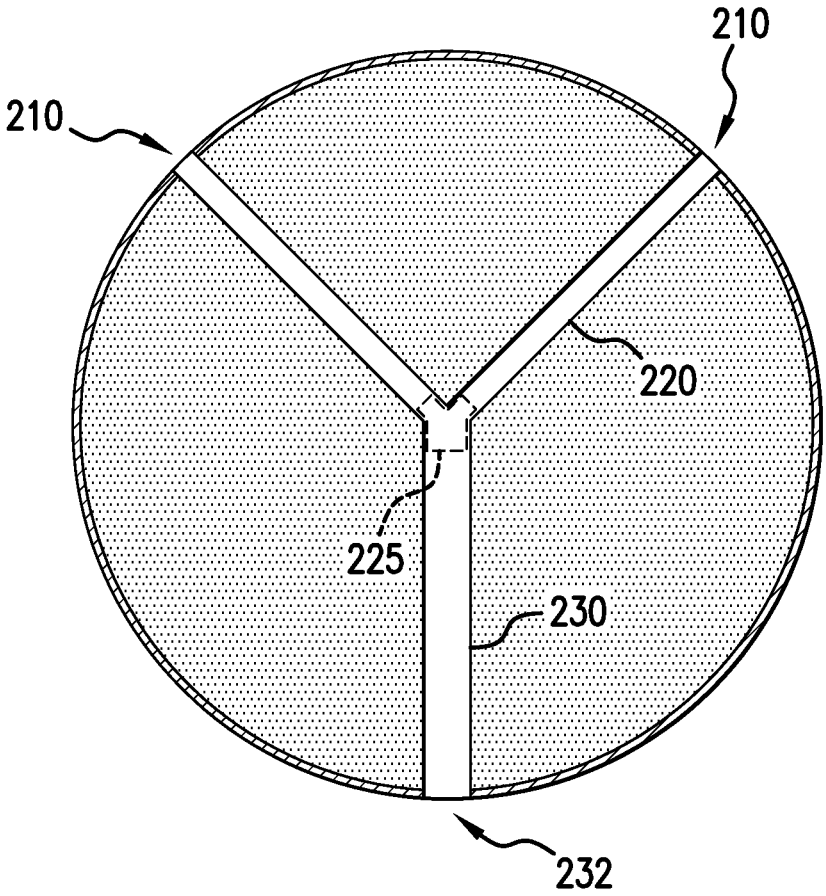
FIG. 5 is a cutaway illustration of a ball showing interior channels, a central chamber, and a common shaft, according to various embodiments.

FIG. 5 is a sectional or cutaway illustration showing the interior of a ball 200, according to various embodiments. The parachute assembly in this embodiment includes four suspension lines 140 and four attachment points 210. As described above; for N=4, L=ninety degrees. Accordingly, a section line passes through two of the attachment points 210 (spaced one hundred eighty degrees apart) as shown.

Each attachment point 210 defines an opening to an interior channel 220, as shown in FIG. 5. The channel 220 extends from the opening to a central chamber 225 located near the geometric center of the ball. As shown, the interior channels 220 may lie along a substantially radial axis. Each channel 220 is sized and shaped to receive at least one of the suspension lines. Any of a variety of tools and techniques may be used to make the interior channel 220 in the body of the ball. In one embodiment, the channel 220 may be made by drilling, boring, or using another rotating tool and, thus, may have a generally cylindrical shape.

As shown, the channels 220 converge in a central chamber 225 near the center of the ball, where the channels 220 meet a common shaft 230. The common shaft 230 extends from a shaft opening 232 to the central chamber 225. Like the interior channels 220, the common shaft 230 may lie along a substantially radial axis with respect to the ball 200. The shaft opening 232 may be located at the south pole, in terms of equatorial coordinates. The common shaft 230 may be substantially cylindrical in shape and may be formed by drilling or boring, for example, with a rotating tool. Any of a variety of tools and techniques may be used to make the shaft 230. The common shaft 230 may be larger in diameter than the interior channels 220, in order to accommodate passage of more than one of the lines 140 and/or a retainer 240 for connecting the lines 140 together. In one embodiment, the common shaft 230 is sized and shaped to receive a bundle of substantially all of the suspension lines 140.

Figure 6:
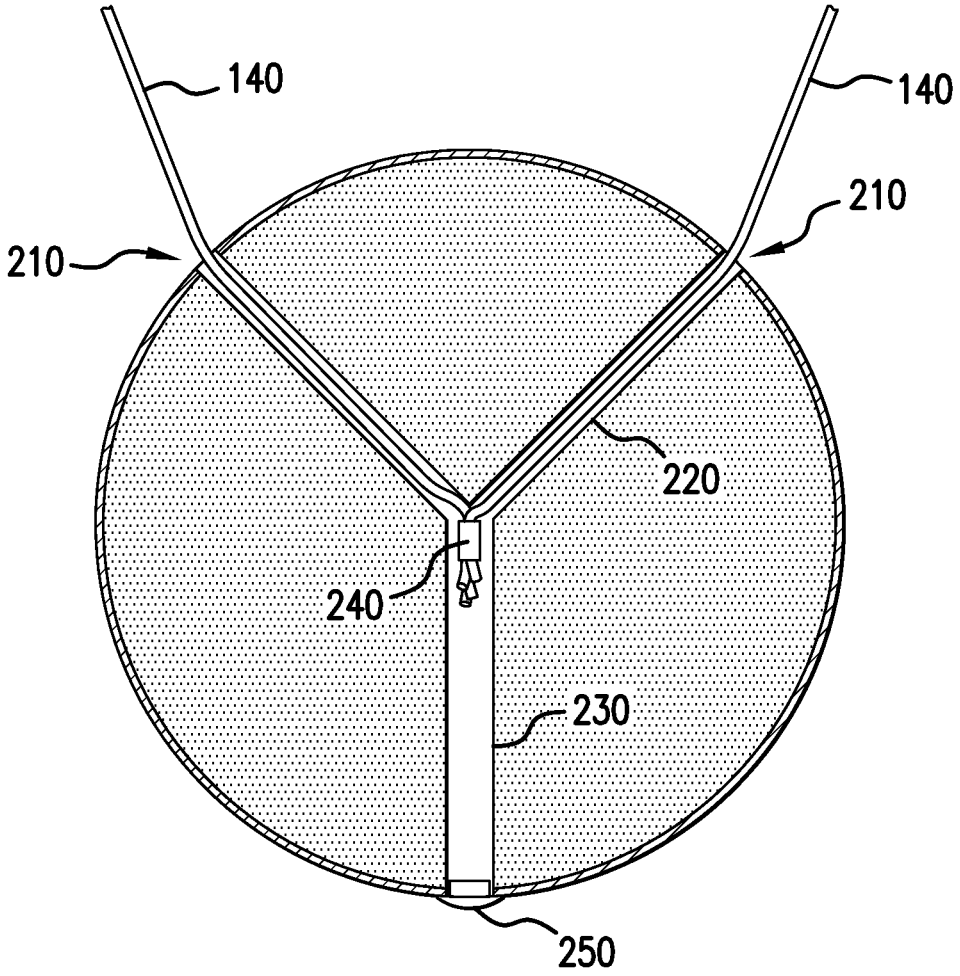
FIG. 6 is a cutaway illustration of a ball showing a plurality of suspension lines fastened together by a retainer and secured near a central chamber, according to various embodiments.

As shown in FIG. 6, the retainer 240 may be a clasp or any type of fastener suitable for joining the lines together. In some embodiments, the retainer 240 may be a hand-tied knot made by intertwining the lines 140 together. As described below, after the retainer 240 is applied, the lines 140 may be withdrawn through the channels 220 and out of the ball through the openings defined by the attachment points 210, as illustrated in FIG. 6, until the retainer 240 reaches a place near the central chamber 225 and/or the lines 140 are substantially taut relative to the ball 200.

Figure 4A:
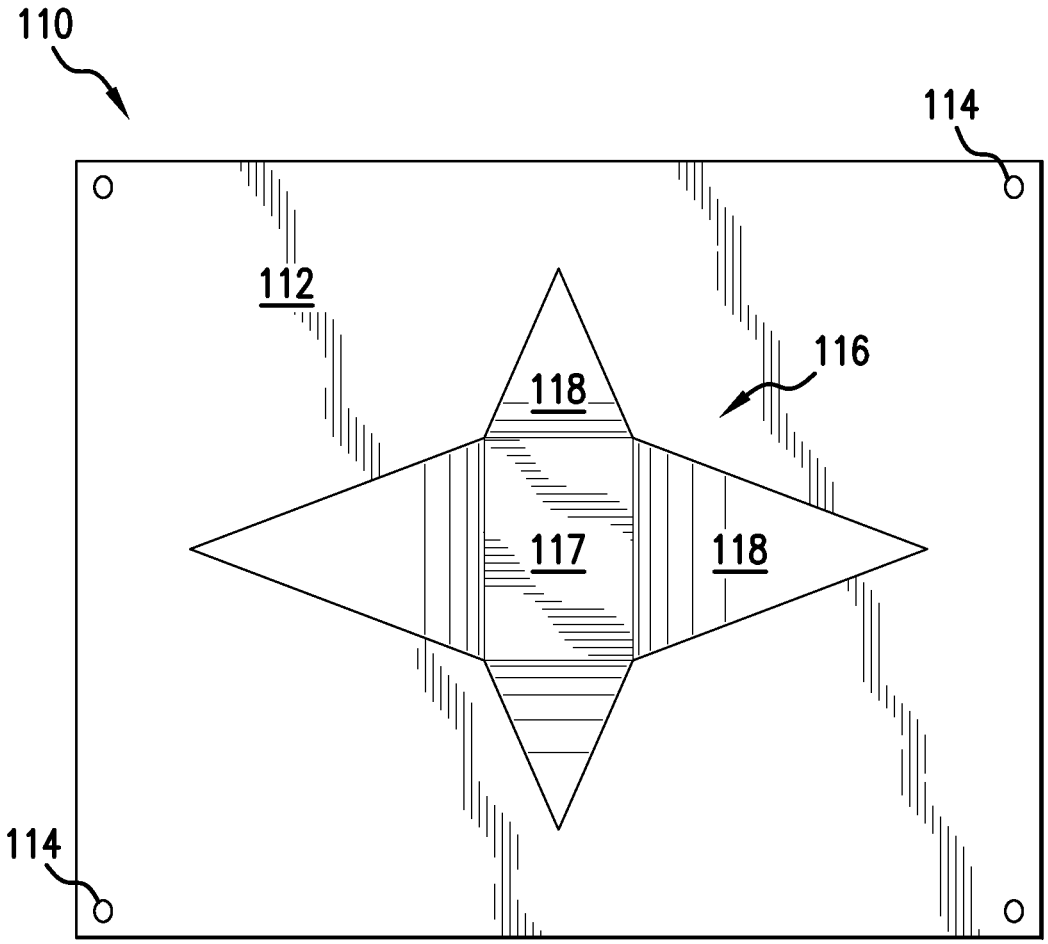
FIG. 4A is a plan view of a canopy with a central portion and a peripheral skirt portion, according to various embodiments.

The canopy 110 in one embodiment may includes a central portion 116 and a peripheral skirt portion 112, as illustrated in FIG. 4A (plan view). This rectangular embodiment includes four eyelets 114; one near each corner of the fabric. As shown, the central portion 116 may include a plurality of substantially triangular gussets 118 extending outwardly from a central panel 117 toward the peripheral skirt portion 112. The central portion 116 may be made of the same or similar fabric.

Figure 4B:
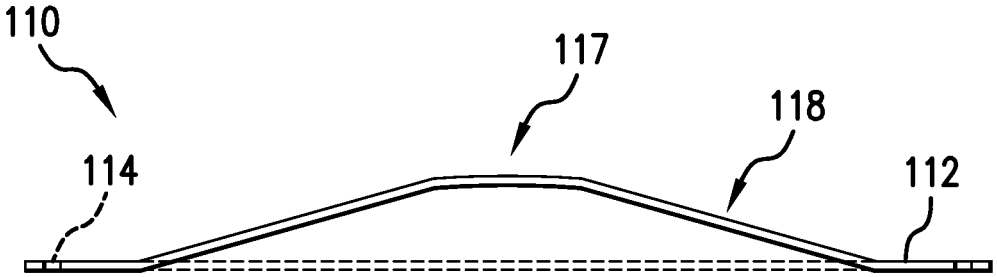
FIG. 4B is a side view of a canopy with a central portion and a peripheral skirt portion, according to various embodiments.

The central portion 116 and skirt portion 112 may be made from a single piece of fabric, or multiple pieces. In one embodiment, the central portion 116 is sewn to the peripheral skirt portion 112. As shown in the side view, FIG. 4B, the gussets 118 may be sized and shaped so that, when the canopy 110 is open, the gussets 118 expand and the central portion 116 extends above the plane of the peripheral skirt portion 112. In this aspect, the gussets 118 support the expansion of the central portion 116 and the central panel 117, which may be any size or shape.

Attachment Technique

In another aspect, a method of attaching a parachute assembly to a ball, in one embodiment, includes the steps of locating the attachment points 210, making a plurality of interior channels 220, making a common shaft 230, inserting the suspension lines 140 into and through the channels and common shaft, fastening together the lines to form a bundle, and then withdrawing the lines until the bundle is secure inside the ball, as shown in FIG. 6.

In one embodiment, the task of locating the attachment points 210 along the upper hemisphere 202 of the ball 200, as described above and illustrated in FIG. 2 and FIG. 3, includes two steps. First; locating a line of substantially equal latitude 204 relative to the equatorial plane 206, as shown in FIG. 2. The angle of inclination 212 in one embodiment may be between about twenty to about sixty degrees. The second step includes dividing the circumference of the ball 200, longitudinally, into a substantially equal number of spaces, as shown in FIG. 3. According to the formula, the longitudinal spacing L (in degrees) equals the three hundred sixty degrees divided by the number of suspension lines, N. Then, as shown in FIG. 3, the attachment points 210 may be located at the intersection of the line of substantially equal latitude 204 and the vectors representing each longitudinal spacing.

The step of making an interior channel 220 for each suspension line 140 in one embodiment includes drilling the interior channel 220 by starting near the attachment point 210 and stopping near the approximate geometric center of the ball 200. This step may include selecting a tool such as a drill bit that is sized and shaped to create an interior channel 220 that is sized and shaped to accommodate the insertion of at least one suspension line 140. In one exemplary embodiment, this step includes creating a number of interior channels 220, all of which meet in a central chamber 225 located near the geometric center of the ball 200, as shown in FIG. 5.

Similarly, the step of making a common shaft 230 in one embodiment includes selecting a starting point where a shaft opening 232 will be made. In one embodiment, the shaft opening 232 may be located near the south pole, relative to the equatorial plane of the ball 200. Drilling the common shaft 230 includes starting at the shaft opening 232 and stopping at the central chamber 225, as shown in FIG. 5.

The task of inserting the suspension lines 140 into the ball includes, in sequence, inserting each line 140 into an interior channel 220, passing each line through the central chamber 225, into and through the common shaft 230, and out of the shaft opening 232. This task may be accomplished manually or with the assistance of a machine or tool. For example, a threading tool may used to pull the lines 140 through the interior channels 220 and through the common shaft 230.

With all of the suspension lines 140 positioned outside of the shaft opening 232, the next step includes fastening the lines together in a bundle. In one embodiment, a retainer 240 to fasten the lines together may be a metal clasp or any type of suitable fastener. In one embodiment, the retainer 240 is a hand-tied knot made by intertwining the lines 140 together. After the retainer 240 is applied, the bundle of lines 140 may be withdrawn through the channels 220 and out of the ball through the openings defined by the attachment points 210, as illustrated in FIG. 6, until the retainer 240 reaches a place near the central chamber 225. In one embodiment, the pulling action may facilitate a substantially permanent seating of the retainer 240 against one or more interior surfaces inside the central chamber 225. Where the retainer 240 is a knot, the pulling action may facilitate tightening of the knot. In this aspect, the retainer 240 substantially prevents the inadvertent withdrawal of the lines 140 out of the ball 200.

In one embodiment, the shaft opening 232 may be either left open or capped with a plug 250. The plug 250 may be sized and shaped for a compression fit inside the opening 232 or it may be secured with one or more fasteners.

The openings located near the attachment points 210, where the suspension lines 140 emerge from the ball 200, may be either left open or furnished with a rim such as a grommet to protect the edges of the opening and/or protect the lines 140 from excessive wear.

Packing Technique

In another aspect, various embodiments include a technique for packing the parachute assembly 100 around an object such as a ball 200. In one exemplary embodiment, the packing technique begins with placing the parachute canopy 110 on a surface. The canopy 110 may be folded approximately in half, with most or all of the suspension lines 140 lying from the perimeter edge of the canopy 110 toward the ball 200.

The canopy 110, in one embodiment, may be folded approximately in half again.

The ball 200 may be placed near the center of the folded canopy 110. Most or all of the suspension lines 140 may be clustered together with one another.

With the ball 200 near the center of the folded canopy 110, the canopy 110 may now be wrapped around the ball in order to form a loose pouch with the ball inside.

One embodiment includes twisting the canopy fabric around the ball. The amount of twisting and the resulting tightness of the canopy fabric against the ball may vary depending on the particular intended use. The twisting step may or may not be necessary, depending on various factors including the type of ball, the size of the canopy, the intended height of the throw, and the like. The wrapping and twisting steps may be accomplished at or near the same time.

Training Technique

In another aspect, various embodiments of the invention include a technique for training a person to catch an object such as a ball. In one exemplary embodiment, the training technique begins with grasping the ball and canopy 110 after completion of some or all the steps of the packing technique described above. The grasping action may be accomplished by either hand. While maintaining the wrapped and/or twisted condition of the canopy around the ball, the user may throw the ball into the air. Throwing may be performed with a goal of launching the ball upwardly into the air, in a relatively high arc, toward the student or other person to be trained. Throwing may be performed by hand or by striking the wrapped ball with an object such as a bat.

As the ball travels along its path of flight, the canopy may unwrap or otherwise open, filling with air and slowing the descent of the ball as it descends. Because the ball speed is slowed by the open canopy, the student may experience a longer time during which to prepare to catch the ball. Accordingly, the technique of catching may be practiced, for example, with more time for instruction, more time for the user to move into position in the path of the ball, and more time to experience and practice the tactics that are most helpful in preparing to catch a ball in flight.

In another aspect, various embodiments of the elements described above form a system for training a person to catch an object such as a ball. In one exemplary embodiment, the system includes a parachute assembly 100, a method of attaching the parachute assembly to a ball, a packing technique, and a training technique, as described above.

CONCLUSION

Although the parachute assemblies and methods are described herein in the context of slowing the descent of an object such as a baseball, the technology disclosed herein is also useful and applicable in other contexts. Moreover, although several embodiments have been described herein, those of ordinary skill in art, with the benefit of the teachings of this disclosure, will understand and comprehend many other embodiments and modifications for this technology. The invention therefore is not limited to the specific embodiments disclosed or discussed herein, and that may other embodiments and modifications are intended to be included within the scope of the appended claims. Moreover, although specific terms are occasionally used herein, as well as in the claims or concepts that follow, such terms are used in a generic and descriptive sense only, and should not be construed as limiting the described invention or the claims that follow.

The invention claimed is:

1. A parachute assembly for slowing the descent of an object in flight, said parachute assembly comprising:
- a canopy having a peripheral skirt portion; and
- a plurality of suspension lines attached at the upper ends thereof to said peripheral skirt portion and converging downwardly to a corresponding number of attachment points located along an upper hemisphere of a ball,
- wherein said attachment points are substantially equidistantly spaced apart and thereby facilitate a substantially equidistant spacing of said plurality of suspension lines,
- wherein each of said attachment points defines an opening to an interior channel extending from said opening to a central chamber located near a geometric center of said ball, wherein each of said interior channels is sized and shaped to receive at least one of said plurality of suspension lines, and
- wherein said assembly further comprises a common shaft extending from said central chamber to a shaft opening located on an outer surface of said ball, wherein said common shaft is sized and shaped to receive a bundle comprising substantially all of said plurality of suspension lines.

2. A parachute assembly for slowing the descent of an object in flight, said parachute assembly comprising:
- a canopy having a peripheral skirt portion;
- a plurality of suspension lines attached at the upper ends thereof to said peripheral skirt portion and converging downwardly to a corresponding number of attachment points located along an upper hemisphere of a ball,
- wherein said attachment points are substantially equidistantly spaced apart and thereby facilitate a substantially equidistant spacing of said plurality of suspension lines,
- wherein each of said attachment points defines an opening to an interior channel extending from said opening to a central chamber located near a geometric center of said ball, wherein each of said interior channels is sized and shaped to receive at least one of said plurality of suspension lines, and
- wherein said assembly further comprises a common shaft extending from said central chamber to a shaft opening located on an outer surface of said ball, wherein said common shaft is sized and shaped to receive a bundle comprising substantially all of said plurality of suspension lines; and
- a retainer for fastening together said bundle.

3. A parachute assembly for slowing the descent of an object in flight, said parachute assembly comprising:
- a canopy having a peripheral skirt portion;
- a plurality of suspension lines attached at the upper ends thereof to said peripheral skirt portion and converging downwardly to a corresponding number of attachment points located along an upper hemisphere of a ball,
- wherein said attachment points are substantially equidistantly spaced apart and thereby facilitate a substantially equidistant spacing of said plurality of suspension lines,
- wherein each of said attachment points defines an opening to an interior channel extending from said opening to a central chamber located near a geometric center of said ball, wherein each of said interior channels is sized and shaped to receive at least one of said plurality of suspension lines, and wherein said assembly further comprises a common shaft extending from said central chamber to a shaft opening located on an outer surface of said ball, wherein said common shaft is sized and shaped to receive a bundle comprising substantially all of said plurality of suspension lines; and a plug fitted to substantially cover said shaft opening.

* * * * *